United States Patent [19]

Izzi

[11] Patent Number: 4,582,980

[45] Date of Patent: Apr. 15, 1986

[54] GLOW PLUG FOR DIESEL ENGINES OF MOTOR VEHICLES

[75] Inventor: Gilberto Izzi, Milan, Italy

[73] Assignee: Fabbrica Italiana Magneti Marelli S.p.A., Italy

[21] Appl. No.: 679,830

[22] Filed: Dec. 10, 1984

[30] Foreign Application Priority Data

Mar. 9, 1984 [IT] Italy ..... 19959 A/84

[51] Int. Cl.[4] ..... F23Q 7/22

[52] U.S. Cl. ..... 219/270; 123/145 A; 219/260; 219/523; 219/543; 219/505; 361/266; 431/262; 338/22 R; 338/300

[58] Field of Search ..... 219/244, 260, 267, 270, 219/505, 523, 543, 553; 123/145 R, 145 A; 361/93, 264, 265, 266; 431/262; 338/20, 22 R, 22 SD, 210, 300, 308

[56] References Cited

U.S. PATENT DOCUMENTS

| | | | |
|---|---|---|---|
| 2,482,551 | 9/1949 | Korsgren | 219/260 X |
| 2,708,252 | 5/1955 | Cohn | 219/260 |
| 2,708,253 | 5/1955 | Cohn | 219/270 |
| 2,846,557 | 8/1958 | Schultze et al. | 219/267 |
| 4,211,204 | 7/1980 | Glauner et al. | 123/145 A |
| 4,423,309 | 12/1983 | Murphy et al. | 219/270 |
| 4,476,378 | 10/1984 | Takizawa et al. | 219/270 |
| 4,477,717 | 10/1984 | Walton | 219/267 |

FOREIGN PATENT DOCUMENTS

| | | | |
|---|---|---|---|
| 3003799 | 2/1980 | Fed. Rep. of Germany | 123/145 A |
| 57-26326 | 2/1982 | Japan | 219/270 |
| 58-6327 | 1/1983 | Japan | 219/270 |
| 254482 | 7/1926 | United Kingdom | 219/270 |
| 1127454 | 9/1968 | United Kingdom | 219/270 |
| 2013277 | 8/1979 | United Kingdom | 219/270 |

*Primary Examiner*—Volodymyr Y. Mayewsky
*Attorney, Agent, or Firm*—Ostrolenk, Faber, Gerb & Soffen

[57] ABSTRACT

A glow plug for preheating the combustion chamber of a diesel engine includes a tubular metal sheath (5) closed at an end to define a tip and in which an electric heating element spiral (7) is embedded within a powder (6) of an electrically insulating material. The spiral (7) is connected by one end to the sheath tip and and at its other end to a current feeder (4). The filament (8) of the spiral (7) is advantageously made of a Fe-Cr-Al alloy and is coated for an initial length ($L_1$) of the spiral (7), from the connection location thereof with the current feeder (4), with a high electrical conductivity material (9), preferably nickel (Ni) having a very high positive temperature coefficient of resistance with respect to that of the filament (8). The uncoated end length ($L_2$) of the spiral (7) acts as a heating element while the initial coated length ($L_1$) acts as a control resistance element for the supply current upon increase in the sheath temperature. The thickness of the coating (9) and the coated length $L_1$ of the spiral (7) are chosen to provide the desired electric and thermal characteristics of the glow plug.

5 Claims, 3 Drawing Figures

GLOW PLUG FOR DIESEL ENGINES OF MOTOR VEHICLES

BACKGROUND OF THE INVENTION

This invention relates to a glow plug for diesel engines of motor vehicles, comprising a hollow metal body, a current feeder and a tip-closed tubular metal sheath, containing an electrical spiral embedded within an electrically insulated material. The invention also relates to a process of manufacture of the spiral As well known, a winding arranged within a sheath performs the function of causing the sheath to glow for sufficiently heating the combustion chamber in which the sheath projects in order to facilitate the start of the heat engine at low temperatures. However, the winding requires some time for raising the sheath temperature to the required value for fuel self-combustion. This waiting time, commonly referred to as preheating time, is signalled to the driver by means of an alarm lamp which is normally lit at the first rotation of the igniting change-over switch and is extinguished when the engine is ready for start. However, after this instant, the winding continues to be supplied for an additional time to enable the driver to provide for start operation, whereupon the supply is discontinued.

In order to reduce said preheating time to a few seconds and also avoid that during said additional supply time the winding is unduly heated, with the risk of filament breakage, several expedients have been made to the winding shape and structure.

According to the British patents No. 1,127,454 and 2,013,277, in order to provide a faster heating of the sheath at supply beginning and then a current limitation to avoid any overheating of the filament, the latter comprises two series connected spirals having different operation and characteristics. One of these spirals, particularly the end spiral, performs the function of particularly heating the plug tip (heating spiral), while the other spiral, or initial spiral, performs the function of current control (resisting spiral), so that during the additional supply time the filament temperature is maintained within reasonable limits.

It is evident that the manufacture of such a glow plug is highly costly both for the use of the two spirals or windings having different characteristics and the required welding operation for the connection thereof.

Also it is evident that, in order to provide a good welding operation between the two spirals or windings, it is required that during operation the two ends to be connected are brought to and maintained correctly juxtaposed, and additionally that said ends terminate at the same level, or that none of these ends project relative to the other. Of course, in order to satisfy these conditions, use must be made of a sophisticated and accordingly expensive equipment, to the disadvantage of the final cost of the glow plug.

It should also be noted that the filaments for the two spirals or windings have a small diameter, and accordingly the connection of the ends thereof requires the use of a laser apparatus, since an actual microweld has to be effected. Further, in order to carry out the various operations, an operator needs a monitor or an enlarging apparatus.

In any case, the weld would generate a discontinuity in the filament, that is a weak location where an interruption may occur either due to mechanical failure or fusion due to undue heating of a small size zone.

Finally, the use of two spirals or windings involves complications in construction when desiring to pass from a production of glow plug having certain characteristics to a further production of glow plugs having different characteristics. In this case, it would be necessary to replace one or both spirals or windings.

SUMMARY OF THE INVENTION

It is the object of the present invention to provide a glow plug of simple and inexpensive construction, the winding of which has no welding locations.

It is another object of the invention to provide a process for the manufacture of glow plugs allowing, by simple modifications to the filament structure, to vary the electric and thermal characteristics of the glow plug, to enable thereby to pass from a glow plug production series to another series of different characteristics, still using the same basic winding.

According to the invention, the above objects are achieved by a glow plug characterized by a single or mono-spiral, the filament of which for an initial length of the spiral from the connection location with the current feeder is coated with high electric conductivity material, the resistance of which has a very high positive temperature coefficient with respect to the filament material, so that the end length of spiral will behave as a heating element for the sheath, while the initial coated length will behave as resistant or control element for the supply current.

A glow plug according to the invention has the advantage of using a weldless spiral, and also the possibility of varying the electric and thermal characteristics thereof by varying the dimensions of the conductive coating.

In a preferred embodiment of the invention, the filament material comprises an alloy of Fe-Cr-Al, whereas the conductive coating is a Ni based material.

The process for spiral manufacture consists of treating the spiral in a galvanic or plating bath of coating metal salts after protecting the end length of the spiral not involved with coating with a layer of insulating material, and finally removing the insulating layer from the filament of the end length of the spiral.

It is clearly apparent that in case of nickel coating, the spiral bath treatment will consist of nickel-plating.

The process allows a simple and quite inexpensive production of glow plugs of different characteristics only by varying the length and thickness of the conductive coating layer.

Further characteristics and advantages of a glow plug according to the invention will become apparent from the following description and relative drawings relating by mere way of example to a preferred embodiment of the invention.

DESCRIPTION OF THE PREFERRED EMBODIMENT

Figure 1:
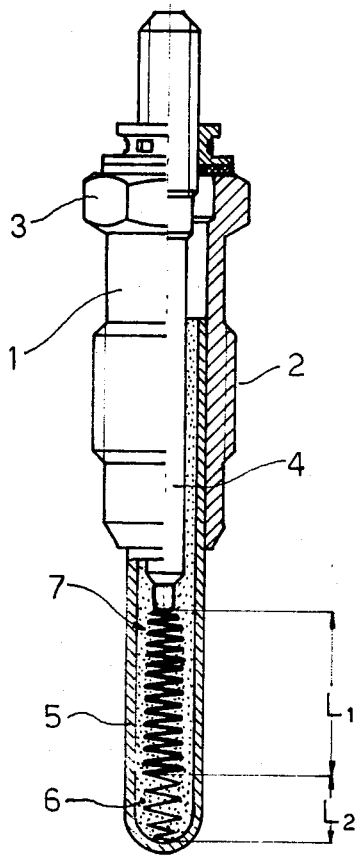
FIG. 1 is a partly cutaway view showing a glow plug according to the invention.
Figure 2:
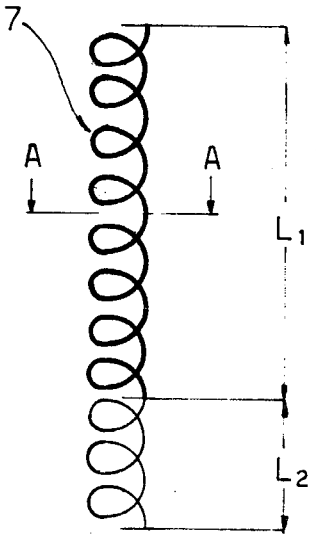
FIG. 2 is an enlarged view showing the partly coated spiral used in the glow plug of FIG. 1.

Referring to the accompanying drawing, a glow plug essentially comprises: a hollow metal body 1 provided with screw-threading 2 and nut 3, a current feeder 4 insulatingly secured to the body, and a tubular metal sheath 5 which is closed at the tip and connected by the open side to the interior of said body 1.

The free end of the sheath protrudes into the combustion chamber (not shown) of the heat engine to act as glowing element, while said current feeder 4 is connected to an electric power supply (also not shown).

Within said sheath 5, embedded in an insulating material 6 comprising a compressed powder of MgO, is a single or mono-spiral 7 is placed and connected by one end to the current feeder 4 and by the other end to the interior of the sheath tip. The powder 6 also separates said sheath 5 from that portion of the current feeder 4 which is inserted therein.

Figure 3:
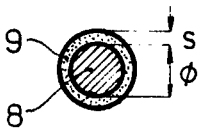
FIG. 3 is an enlarged sectional view according to line A—A of the spiral shown in FIG. 2.

According to the invention, the spiral 7 comprises a filament 8 (see FIG. 3) which for an initial length $L_1$ of the spiral from the connection location with the current feeder 4 is coated with high electric conductivity material 9 (see FIG. 3), the resistance of which has a very high positive temperature coefficient with respect to that of the material of the filament 8.

Said filament 8 comprises an alloy of Fe-Cr-Al while the conductive coating comprises nickel (Ni). The selection of these materials is in connection with the characteristics thereof as required in the specific use for glow plugs. The alloy Fe-Cr-Al has a high electric resistance and low temperature coefficient, while nickel has opposite characteristics, that is a low electric resistivity and high temperature coefficient.

By such materials, the end length $L_2$ of the spiral (length with uncoated filament), as supply starts, will behave as heating element, thereby rapidly bringing the sheath tip to fuel igniting temperature, while the initial length $L_1$ (length with coated filament) at supply start promotes the passage of current, but then, due to the increase of temperature in the sheath, and accordingly due to the considerable increase in resistance thereof, will obstruct the flow thereof, thereby acting as current control or resistant element, so that the spiral temperature throughout the supply time is maintained with reasonable limits.

It is apparent that in a glow plug according to the invention, the spiral comprises a continuous filament, that is a filament without any joints, welds and the like. Therefore, no risk of filament breakage would occur, which instead may occure in the prior art dual spiral glow plugs. But, above all, said spiral 7 does not require any welding operations which, as well known, are of difficult and costly execution.

A partly coated spiral may be obtained by any suitable process. However, a particularly convenient process, because allowing to easily vary the dimensions of the conductive coating, will now be described with reference to a glow plug using nickel as conductive coating. The process comprises the following steps:

(a) the end length $L_2$ of the spiral is protected with a layer of electrically insulating material. This protective layer may be provided by sputtering, spreading or immersion in a bath of the selected insulating material, such as paint, resin or the like;

(b) the whole spiral thus partly protected is treated in a galvanic or plating bath of Ni salts, as suitably activated. Thus, the electrochemical deposit is provided on Ni (nickel-plating) on the filament of the initial length $L_1$ of the spiral, but not on the end length $L_2$, which is protected by the insulating layer;

(c) then, the protective layer is removed from the length $L_2$ and the spiral is ready for welding to the feeder 4 and then arranged in the sheath by known techniques. The protection removal may be carried out by means of solvent or any other chemical or mechanical system.

The above described spiral manufacture system can be readily automated since the spiral by a continuous conveying system is first subjected to the protection operation for length $L_2$ (step a), then to treatment in the galvanic or plating bath (step b), and finally to removal of the protection (step c).

By the above manufacture system, it is possible to accurately predetermine the final characteristics of a glow plug. Thus, by varying the length of $L_2$, the length of $L_1$ to be coated is exactly defined, as well as, by varying the time of treatment of the spiral in the bath, the thickness s (see FIG. 3) of the metal deposited on the filament can be varied. As a result, under same other conditions, by varying said dimensions, the electric and thermal characteristics of a glow plug can be defined.

For example, by increasing the length of the coated section the total resistance of the spiral is reduced; in this case, the current passing through the spiral at the supply start increases, and accordingly the sheath heating speed or rate increases.

By way of example, it was found that in a standard glow plug, with filament of Fe-Cr-Al alloy and conductive coating of pure Ni, by providing the following ratios $L1/L2 \cong 5$ and $s/\phi \cong 0.1$, where $\phi$ is the filament diameter, a glow plug at room temperature of +20° C. will reach the reference temperature of 850° C. in 4 seconds.

In the above description, reference was made to a filament comprising an alloy of Fe-Cr-Al and a Ni conductive coating, it being apparent that also other materials could be used, provided having similar thermal, electric, mechanical characteristics.

Similarly, also the conductive coating may be made by any other deposit system or application of material different from the electrochemical system described, without departing for this from the scope of the invention.

What is claimed is:

1. A glow plug for diesel engines of motor vehicles, comprising a hollow metal body, a current feeder and a tubular metal sheath closed at a tip and in which an electric spiral (7) is embedded within an insulating material and connected by one end to the current feeder and by the other end to said sheath tip, characterized in that the filament (8) of the spiral (7) for an initial length ($L_1$) of the spiral, from the connection location with the current feeder (4), is coated with electrically conductive material (9), the electric resistance of which has a very high positive temperature coefficient with respect to that of the material comprising the filament, so that the uncoated end length ($L_2$) of the spiral acts as rapid heating element for the sheath as supply start, while the initial length ($L_1$) acts as control resistance element for the supply current upon increase in the sheath temperature, and the thickness of the coating (9) and the coated length ($L_1$) of the spiral being chosen to provide.

2. A glow plug as claimed in claim 1, characterized in that the filament (8) of the spiral (7) comprises material of high electric resistivity and low temperature coefficient, while the conductive coating (9) comprises a material of low electric resistivity and high temperature coefficient.

3. A glow plug as claimed in claim 2, in which the filament (8) of the spiral (7) comprises an alloy of Fe-Cr-Al.

4. A glow plug as claimed in claim 2, in which the conductive coating (9) comprises nickel.

5. A glow plug as claimed in claim 2, in which the filament (8) of the spiral (7) comprises an alloy of Fe-Cr-Al and the conductive coating (9) comprises nickel.

* * * * *